US005852463A

United States Patent [19]

Koshida et al.

[11] Patent Number: 5,852,463

[45] Date of Patent: Dec. 22, 1998

[54] THERMAL RECORDING APPARATUS AND ERASING METHOD OF A RECORD THEREFOR

[75] Inventors: Yoshinori Koshida; Shusaku Tanabe; Satoshi Murakami, all of Tokyo, Japan

[73] Assignee: OKI Electric Industry Co., Ltd., Tokyo, Japan

[21] Appl. No.: 278,068

[22] Filed: Jul. 20, 1994

[30] Foreign Application Priority Data

Mar. 2, 1994 [JP] Japan ..... 6-032263
Aug. 9, 1996 [JP] Japan ..... 5-197366

[51] Int. Cl.[6] ..... B41J 2/32
[52] U.S. Cl. ..... 347/171
[58] Field of Search ..... 247/171; 400/120.01

[56] References Cited

U.S. PATENT DOCUMENTS 5,231,505 7/1993 Watanabe et al. ..... 347/171
5,274,460 12/1993 Yamada et al. ..... 347/171

FOREIGN PATENT DOCUMENTS 2107907 8/1993 Canada ..... 347/171
0583483 2/1994 European Pat. Off. ..... 347/171
0221129 8/1993 Japan ..... 347/171

*Primary Examiner*—Huan H. Tran
*Attorney, Agent, or Firm*—Venable; Robert Kinberg

[57] ABSTRACT

A thermal recording apparatus includes an apparatus unit having a carrier path in which a thermal recording media is carried. A heat member is provided on the carrier path in the apparatus unit for applying heat energy onto the thermal recording media. A control portion is provided for selectively applying a high level driving energy and a low level driving energy to the heat member. When a record on the thermal recording media is erased, the control portion applies the high level driving energy to the heat member, and then applies the low level driving energy to the heat member. When the record is printed onto the thermal recording media, the high level driving energy is applied to the heat member.

6 Claims, 14 Drawing Sheets

THERMAL RECORDING APPARATUS AND ERASING METHOD OF A RECORD THEREFOR

CROSS-REFERENCE TO RELATED APPLICATIONS

This application claims priority benefits under 35 U.S.C. §119 of Japanese Patent Applications No. Hei 5-197366, filed Aug. 9, 1993, and No. Hei 6-032263, filed Mar. 2, 1994, the entire disclosures of which are incorporated herein by reference.

BACKGROUND OF THE INVENTION

1. Field of the Invention

The invention relates to a thermal recording apparatus for performing print and erasion to a thermal recording media using a thermo-reversible recording material, and an erasing method of a record on a thermal recording media.

2. Description of the Related Art

Generally, in an apparatus for printing a record onto a thermal recording media (hereinafter, called as a rewritable card) using a thermo-reversible recording material, it has been proposed to provide a thermal recording apparatus, in which a thermal head is used for a print means, and a heat stamp having a heater is used for an erasing means of a record. However, such an apparatus must separately provide the print means and the erasing means, resulting in an increase in apparatus size. For this reason, another apparatus has been also proposed in which the print thermal head is commonly used for both printing and erasion, so as to erase the record by supplying heat energy, different from the energy used in printing, to the thermal head. The thermal recording apparatus of this type performs the printing and erasion with just one head. This allows the apparatus to achieve a decrease not only in apparatus size, but also in apparatus cost. Making such an apparatus fit for practical use, therefore, has been desired.

However, the conventional apparatus for performing the erasion with the heat stamp, by using a heater, is required to provide an efficiently radiating structure, so that it is difficult to reduce the size and the cost.

In the conventional apparatus of another type for performing both print and erasion with the thermal head, there arises another problem that since heat energy for erasing a record is applied to the thermal recording media for only a short time, the record may not be completely erased if a long period of time elapses after printing, owing to changes in the characteristics of the rewritable card (characteristic changes in the rewritable card, i.e., changes in the erasable temperature range according to the elapsed time up to performing the erasion after printing). This seems to be because the thermo-reversible material activated by the print tends to be stabilized when left in an opaque state (printed state) for a long time, and because the property does not return to an original transparent state (unprinted state) with application of erasing energy in a short time (a few ms or so) by using the thermal head. When re-printing is done without completely returning to the original transparent state, the visual recognizability of the record becomes worse.

Irrespective of whether the heat stamp or the thermal head is used as the erasing means, it is difficult to control for maintaining the proper temperature range of erasion. When a rather higher temperature than the proper erasion temperature is applied to the thermal recording media, the thermal recording media becomes a slightly opaque state. Even if the erasion is performed again under this condition, the thermal recording media will not return to the transparent state, as long as the erasion temperature applied to the thermal recording media is a somewhat higher temperature, similar to the last time. When the printing is done to such a thermal recording media, the visual recognizability of the record becomes worse, and further, if the erasion and printing are repeated, the visual recognizability of the record goes from bad to worse, thus decreasing the lifetime of the thermo recording media.

SUMMARY OF THE INVENTION

It is an object of the present invention is to provide an erasing method of a thermal recording media capable of both printing and erasion with one heat member independently of the length of the elapsed time after printing.

It is another object of the present invention to provide an erasing method of a thermal recording media capable of both printing and erasion with one heat member, enabling a reduction in the size of and the cost of the recording apparatus.

It is yet another object of the present invention to provide an erasing method of a thermal recording media enabling an improvement in the visual recognizability of a record on the thermal recording media even if the thermal recording media is left in a printed state for a long time.

It is still another object of the present invention to provide an erasing method of a thermal recording media, which avoids decreasing the life of the thermal recording media if the erasion is done above the proper temperature range of the erasion.

In order to accomplish the above-mentioned objects, a thermal recording apparatus according to the present invention includes an apparatus unit having a carrier path in which a thermal recording media is sucked and carried; a heat member provided on the carrier path in the apparatus unit for applying heat energy onto the thermal recording media; and a control portion for selectively applying both a high level driving energy and a low level driving energy to the heat member; wherein the control portion applies the high level driving energy to the heat member when a record on the thermal recording media is erased, and then applies the low level driving energy to the heat member.

According to the present invention having the above-mentioned structure, when the record on the thermal recording media is erased, the heat member applies high level driving energy to the thermal recording media. For this reason, the thermal recording media returns to a state immediately after printing, and then the low level driving energy is applied by the control portion to the heat member under this condition, and the heat energy is applied by the heat member to the thermal recording media.

BRIEF DESCRIPTION OF THE DRAWINGS

The above and other features and advantages of the invention will be more clearly understood from the following detailed description of the preferred embodiments with reference to the accompanying drawings in which:

FIG. 7(*b*) is a graph illustrating thermal print head drive pulses according to the first embodiment of the present invention;

FIG. 12(*b*) is a graph illustrating thermal print head drive pulses in overall batched erasing according to the second embodiment of the present invention;

FIG. 12(*c*) is a graph illustrating thermal print head drive pulses in overall batched printing according to the second embodiment of the present invention;

DETAILED DESCRIPTION OF THE PREFERRED EMBODIMENTS

Figure 1:
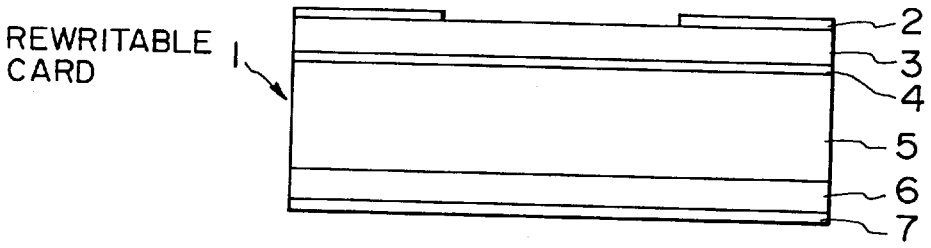
FIG. 1 is a diagram illustrating a configuration of a rewritable card used in the present invention.

Referring now to the drawings, preferred embodiments according to the present invention will be described hereinbelow. In the drawings, common elements adopt the same reference numerals.

(First Embodiment)

A first embodiment according to the present invention will be described.

In FIG. 1, a rewritable card 1 used in this embodiment is formed of a printing layer 2, a record indicative layer 3 formed of a thermo-reversible material, a reflective layer 4, a base material PET (milky-white polyester film) 5, a magnetic layer 6, and protecting layer 7. The printing layer 2 is laminated on a portion of (except the printing portion) the record indicative layer 3.

Figure 2:
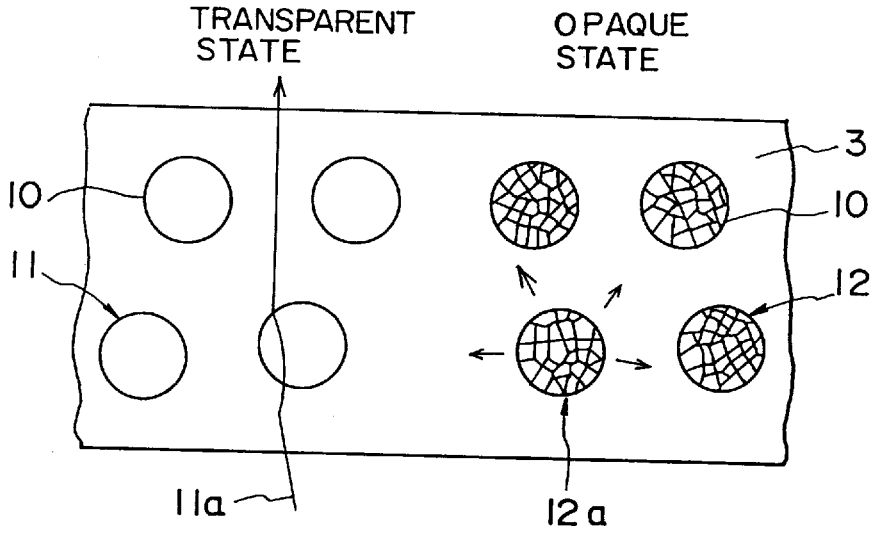
FIG. 2 is a diagram illustrating states of a thermo-reversible recording material.

FIG. 2 shows states on the surface of the rewritable card according to this embodiment. In a transparent state 11, particles 10 of an organic low-molecular material in the thermo-reversible recording material are formed of relatively large single crystals. Therefore, the light 11*a*, coming into the thermo-reversible recording material 3, does not have many times to pass through the crystal surface, so that the entire thermo-reversible recording material 3 looks transparent by passing the light without scattering.

On the other hand, in an opaque state 12, particles of an organic low-molecular material are formed of polycrystals. Therefore, the light 12*a*, coming into the thermo-reversible recording material 3, is refracted on the crystal surface many times so as to scatter, so that the entire thermo-reversible recording material 3 looks opaque.

Figure 3:
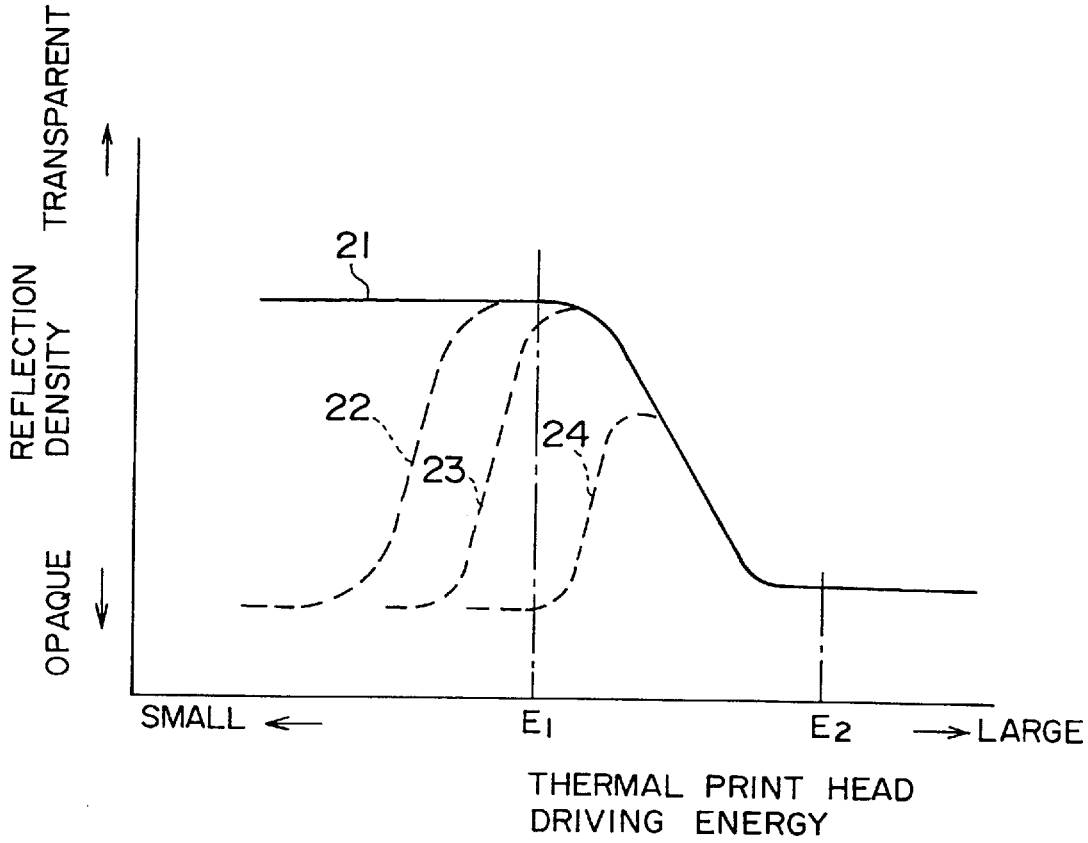
FIG. 3 is a graph illustrating print/erasion characteristics of the rewritable card shown in FIG. 1.

Next, referring to FIG. 3, print/erasion characteristics of the rewritable card will be described. In FIG. 3, the ordinate is for reflection density, in which the direction of "transparent" indicates a state that the rewritable card is erased, and the direction of "opaque" indicates a printed state. The abscissa is for the driving energy of each dot in the thermal print head for performing printing. In the drawing, a print characteristic 21 indicated with a solid line represents changes of the reflection density produced by applying energy from the thermal print head to the card in the transparent (erased) state. Herein, when the applied energy is low, the card maintains the transparent state, and, when the applied energy becomes high, the card becomes opaque. Then, when printing is done, energy "E2" is applied to the rewritable card.

Each characteristic 22, 23 or 24 indicated with dotted lines represents changes of the reflection density produced by applying energy from the thermal print head to the card in the opaque (printed) state. Herein, the characteristic 22 represents a case that the energy is applied immediately after printing; the characteristic 23 represents a case that the energy is applied after the elapse of one day after printing; the characteristic 24 represents a case that the energy is applied after the elapse of one week after printing. When the energy is applied immediately after printing, the record can be erased by applying energy "E1", whereas the case that the energy applied after elapse of one week after printing is subjected to a change of the characteristic, so that the record can not be completely erased by applying energy "E1".

Figure 4:
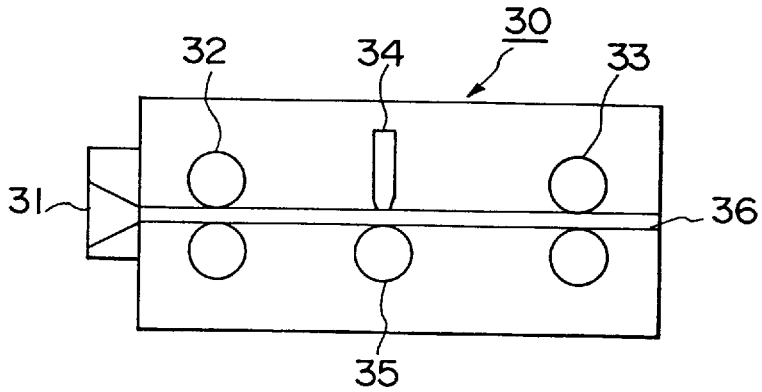
FIG. 4 is a schematic diagram illustrating a print/erasion unit.

FIG. 4 shows a print/erasion unit 30 of this embodiment. In FIG. 4, the print/erasion unit 30 is constituted of a card insert port 31, carrier rollers 32 and 33, a thermal print head 34, a platen 35 and a card carrier path 36. The carrier rollers 32 and 33 are driven by a motor (not shown) used as a driving source so as to carry a card through the card carrier path 36. The thermal print head 34 performs print or erasion by applying energy to a desired position on the card during passage between the head 34 and the platen 35.

Figure 5:
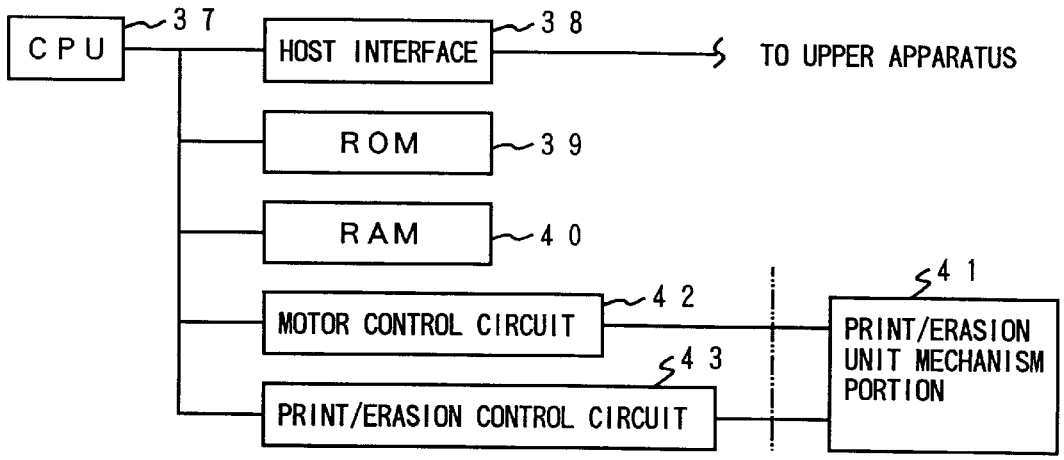
FIG. 5 is a block diagram illustrating a control portion according to a first embodiment of the present invention.

In FIG. 5, a CPU 37 controls the entire operation of the print/erasion unit 30 according to the embodiment. The CPU 37 is commonly connected with a host interface 38, a ROM 39 storing firmware programs and the like of the CPU 37, a RAM 40 temporarily storing data and the like, a motor control circuit 42 for drive-controlling a motor in a print/erasion unit mechanism portion 41, and a print/erasion control circuit 43 for drive-controlling a thermal head 34 in the print/erasion unit mechanism portion 41.

Figure 6:
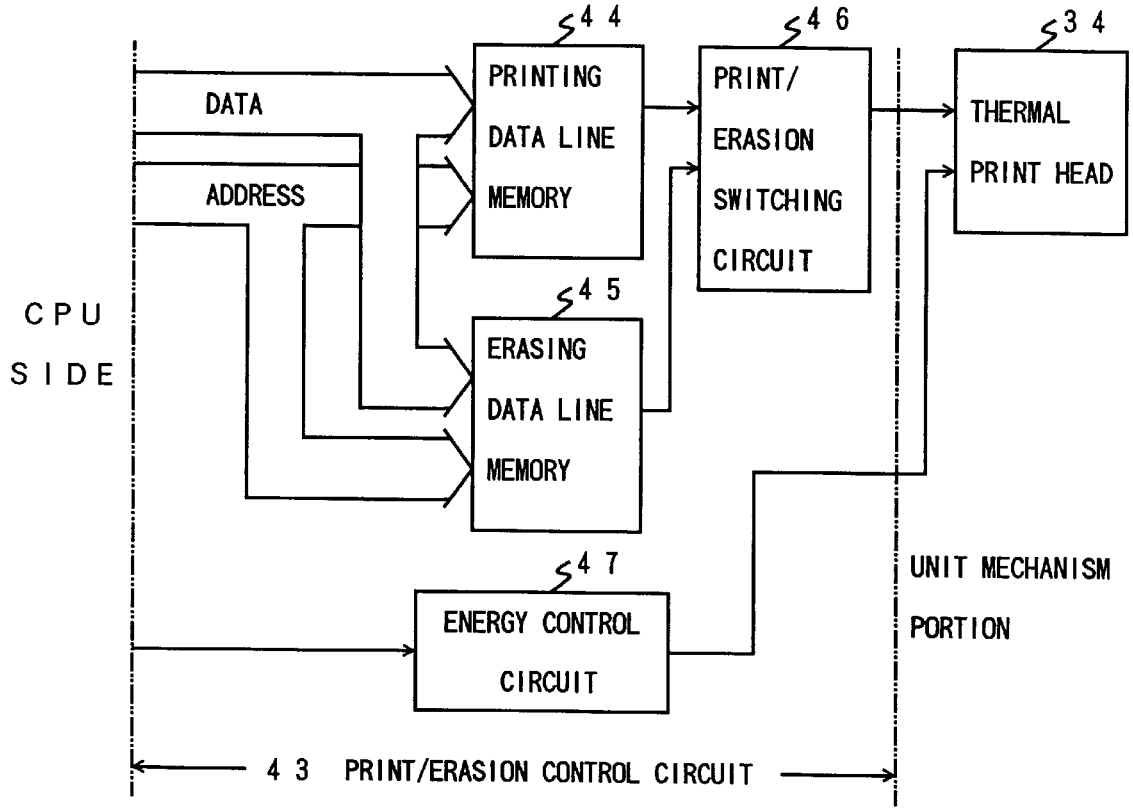
FIG. 6 is a detailed block diagram illustrating a print/erasion control circuit according to the first embodiment of the present invention.

Next, referring to FIG. 6, the structure of the print/erasion control circuit 43 will be described. In FIG. 6, the print/erasion control circuit 43 includes a printing data line memory 44, and an erasing data line memory 45. The printing data line memory 44 temporarily memorizes printing data in a one-dot line of printing in a dot unit. The erasing data line memory 45 temporarily memorizes a portion, where the erasion is required, in a dot unit. Both data stored in these memorizes 44 and 45 are output as serial data to a print/erasion switching circuit 46. The print/erasion switching circuit 46 selects one of the serial data inputs therein so as to output selected data to the thermal print head 34, respectively when printing or erasing data. A energy control circuit 47 controls the driving energy applied to the thermal print head 34 when printing or erasing data. Each circuit mentioned above is controlled by the CPU 37 shown in FIG. 5.

Figure 7A:
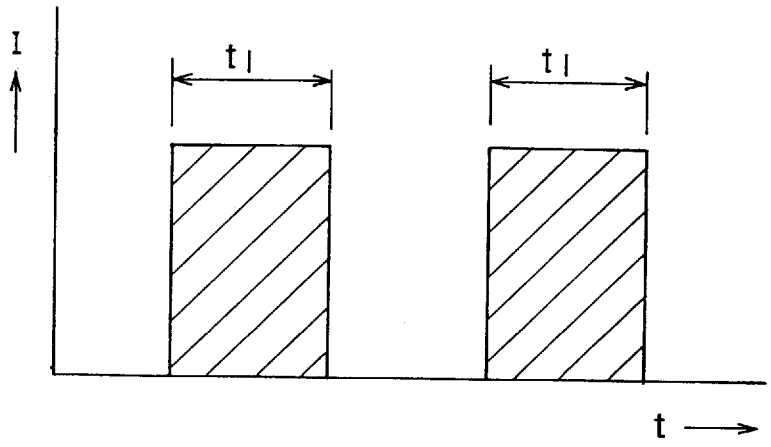
FIG. 7(*a*) is a graph illustrating thermal print head drive pulses according to the first embodiment of the present invention.
Figure 7B:
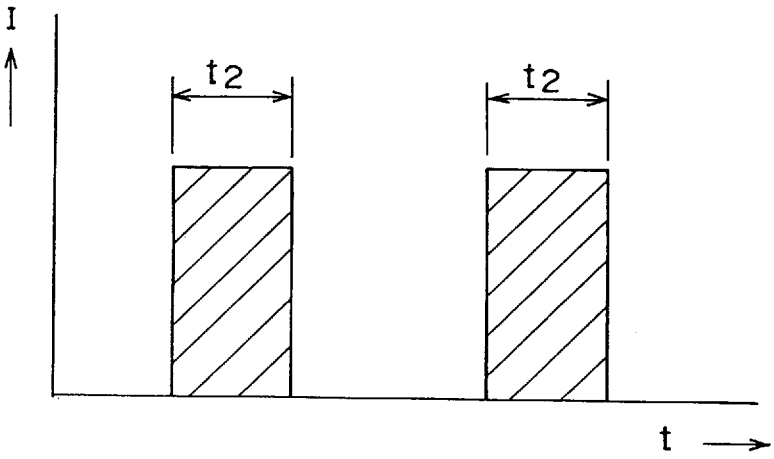

Referring to FIGS. 7 (*a*) and 7 (*b*), a concrete method of the control of the driving energy for the thermal print head 34 will be described. The control of the driving energy is performed by changing a drive pulse width in the thermal print head 34. In FIGS. 7(*a*) and 7(*b*), the ordinate is for print driving current; the abscissa is for time; $t_1$ and $t_2$ represent drive pulse widths. In the drawings, the area of the shadowed portion, i.e., the product of driving current and drive pulse is proportional to the magnitude of the printing energy, and herein, the relation between $t_1$ and $t_2$ is given by $t_1>t_2$. As shown in both drawings, the magnitude of the printing energy can be changed by changing the print pulse width. This can be easily performed by the firmware stored in the control portion according to this embodiment.

Figure 8:
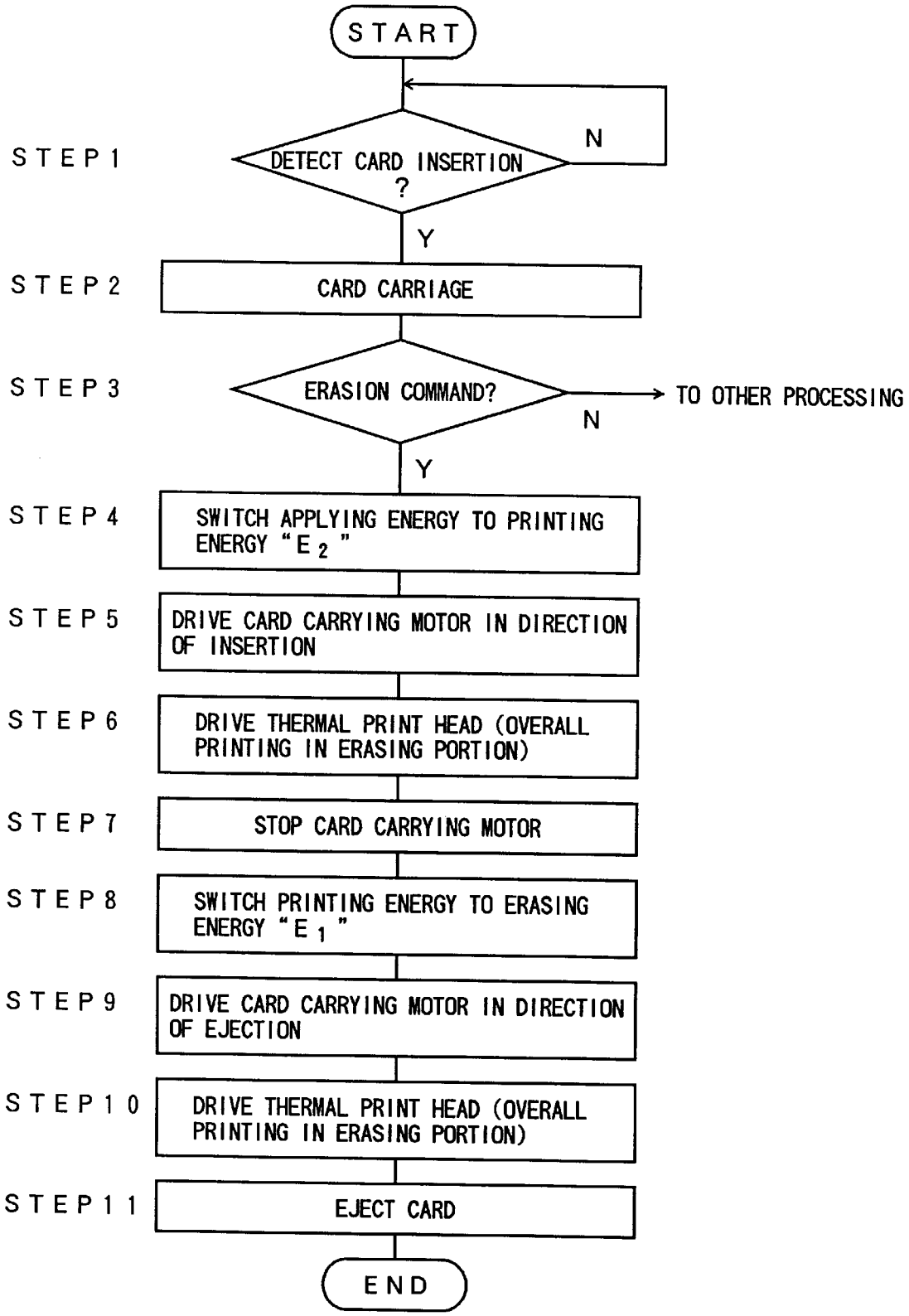
FIG. 8 is a flow chart illustrating an erasion operation according to the first embodiment of the present invention.

Next, referring to a flow chart of FIG. 8, the erasion operation of this embodiment will be described. Firstly, at step 1, when insertion of the rewritable card 1 into the insert port 31 is detected, the CPU 37 informs an upper apparatus of the detection. The detection of the inserted rewritable card 1 is performed by a optical sensor and the like. After the detection, the card 1 is carried into the print/erasion unit 30 by carrier roller 32 at step 2. In step 3, a command transferred from the upper apparatus is determined to be a print command or an erasion command. When it is the print command, the program step goes to a printing processing. Herein, the description of the printing processing will be omitted because it does not take part in this embodiment.

If the command is the erasion command, the program step goes to step 4 to switch the energy, which is applied to the thermal print head 34 by the energy control circuit 47 in the print/erasion control circuit 43, to the printing energy "E2" as shown in FIG. 3. Next, the CPU 37 drives the motor of the print/erasion unit mechanism portion 41 through the motor control circuit 42, rotating the carrier rollers 32 and 33 so as to carry the rewritable card 1 into the print/erasion unit 30 along the direction of insertion (step 5). The direction of insertion indicates a direction which goes toward the right hand from the insert port 31 in the print/erasion unit 30 as shown in FIG. 4. The opposite direction thereto indicates the direction of ejection.

When the rewritable card 1 is carried to the position of the thermal print head 34, dot elements of the thermal print head 34 corresponding to the portion to be erased of the card 1 is driven so as to apply the printing energy "E2" to the portion. Thus, the heat energy is applied to the portion to be erased of the rewritable card 1, and the portion turns to the printed state. That is, an aged change in the characteristic of the card 1 is initialized, the card 1 comes to the state of the characteristic 22 which represents a case that the energy is applied immediately after printing as shown in FIG. 3.

After the print has been done to the portion to be erased, the motor of the carrier rollers 32 and 33 is stopped at step 7, and the energy, which is applied to the thermal print head 34 by the energy control circuit 47 in the print/erasion control circuit 43, is switched to the erasing energy "E1" as shown in FIG. 3 (step 8). Next, the motor of the carrier rollers 32 and 33 is rotated in the opposite direction so as to carry the card 1 in the direction of ejection at step 9. Then, the dot elements of the thermal print head 34 corresponding to the portion to be erased of the card 1 is driven so as to apply the erasing energy "E1" to the portion at step 10. Since the card 1 has the characteristic 22 at the time immediately after printing, the portion to be erased is completely erased by this application. The card 1, where the portion to be erased has been completely erased, is ejected from the insert port 32 by the carrier roller 32 at step 11, and finally, the erasing operation is completed.

Figure 9:
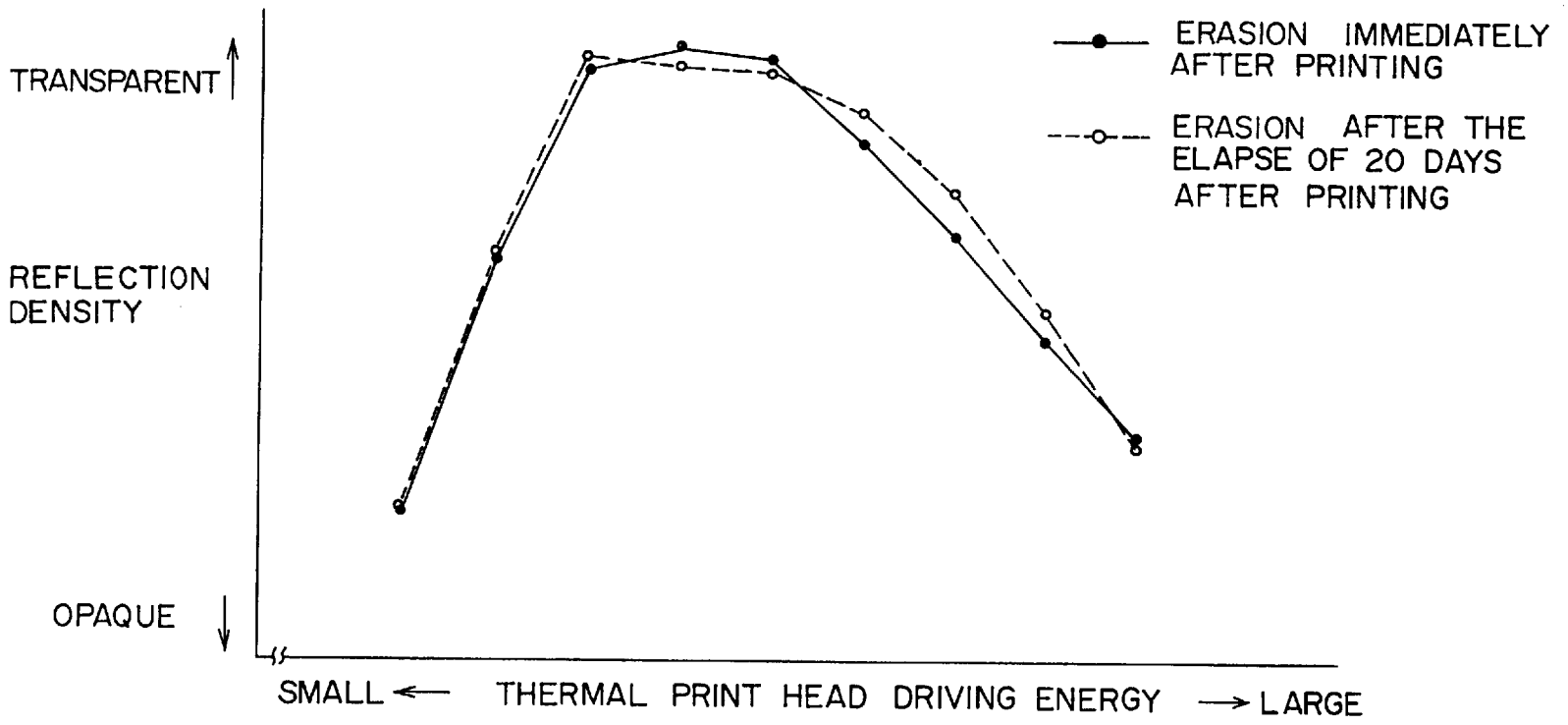
FIG. 9 is a graph illustrating erasion characteristics according to the first embodiment of the present invention.

FIG. 9 shows an erasion characteristic in case of performing the erasion according to this embodiment. In FIG. 9, the solid line represents measured values in case that the erasion is performed immediately after printing; the dotted line represents measured values in case that the erasion is performed after the elapse of 20 days after printing. As shown in FIG. 9, according to the first embodiment, even if the erasion has been performed after the elapse of 20 days after printing, it would be possible to satisfactorily erase the card.

In a practical use, after the erasion end operation, the entire operation may not be finished irrespective of ejecting the rewritable card 1. For example, re-printing may be performed according to instructions from the upper apparatus. In this case, this embodiment can be especially applicable.

In a modified example of the first embodiment, an erasion operation can be performed together with a print operation. In this case, the print operation can be performed during carrying the rewritable card 1 in either direction of insertion or ejection. When the print is performed during carrying the rewritable card 1 in the direction of ejection, heat elements for performing the print of thermal print head 34 are driven by printing energy "E2", while heat elements for performing the erasion of thermal print head 34 are driven by erasing energy "E1". For this reason, both print and erasion processings can be achieved by reciprocating the thermal print head 34 in one line.

As described in detailed above, according to the first embodiment, the printing is performed before the erasion of a record by applying the printing energy "E2" to the portion to be erased, and then the erasion is performed by applying the erasing energy "E1" to the portion. In this manner, for example, in the card, which has a narrow erasion temperature range, due to allowing a long period of time to elapse after the last printing as shown in the characteristic curve 23 of FIG. 3, or even in the card, which can not be completely returned to the transparent state, as shown in the characteristic curve 24 of FIG. 3, the erasion can be performed after the card is returned to the erasable state by applying the erasing energy "E1", in which the erasion temperature range is large enough for a complete erasion, at the time immediately after printing as shown in the characteristic curve 22. This allows the card to be steadily erased of a record by the thermal print head in spite of aged changes of the rewritable card.

As described above, since the steady erasion is obtained by the thermal print head in any cases, it can be reduced both in apparatus size and in apparatus cost.

According to the first embodiment, the erasion is achieved by reciprocating the thermal print head, i.e., the printing is performed in a forward motion, whereas the erasion is performed in a returning motion. For this reason, the entire operation time for the erasion can be reduced, so that an apparatus capable of high speed processing can be obtained. Furthermore, since both printing and erasion operations are performed at the same time, further outstanding apparatus features can be obtained.

(Second Embodiment)

Next, a second embodiment according to the present invention will be described. The second embodiment further includes a function in which the overall printing is done to the entire region of printing and erasion on the rewritable card using ordinary printing energy, or higher energy than that in ordinary printing, and a switch and the like for performing the overall printing under an off-line state.

The print/erasion unit for processing the rewritable card in the second embodiment is the same as that of the first embodiment shown in FIG. 4. That is, in the second embodiment, both printing and erasion are performed to the rewritable card by the thermal print head 34.

Figure 10:
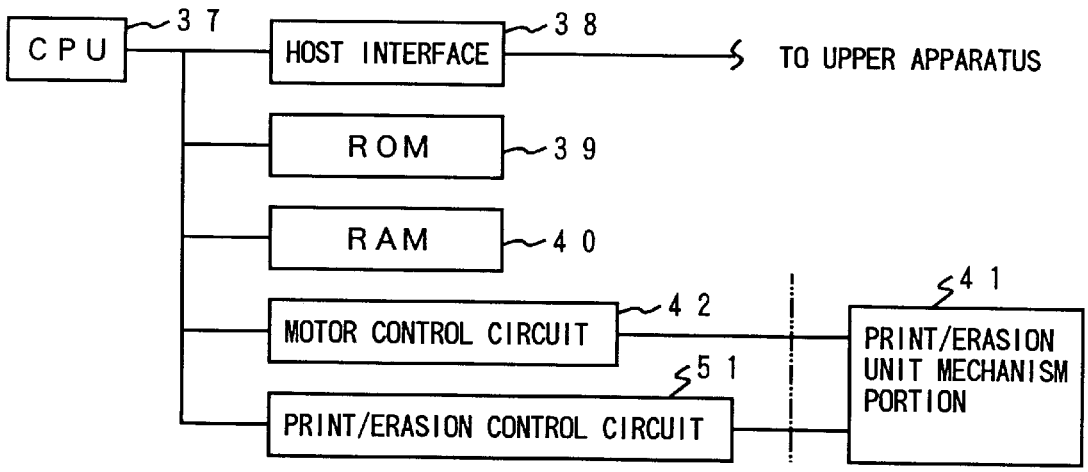
FIG. 10 is a block diagram illustrating a control portion according to a second embodiment of the present invention.
Figure 11:
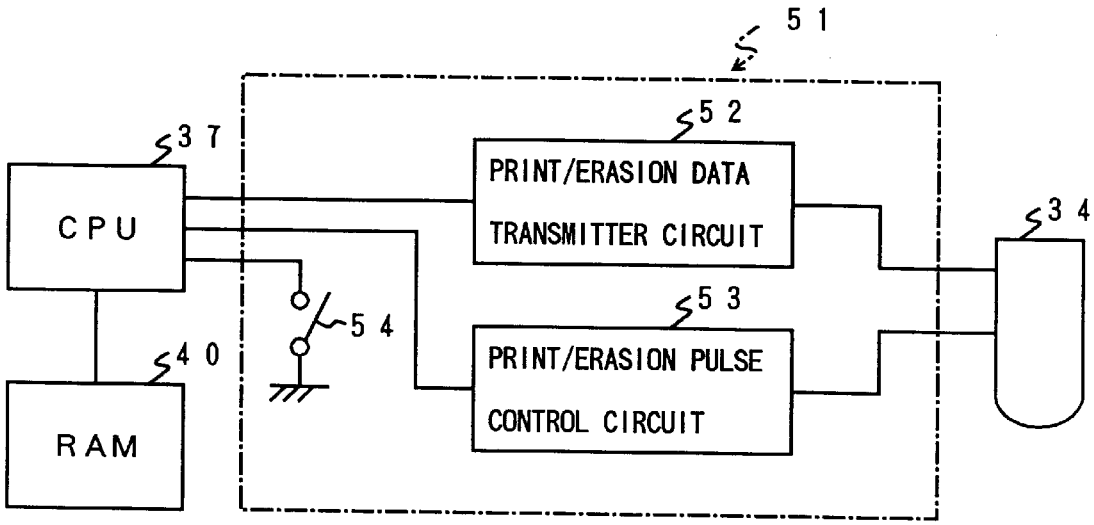
FIG. 11 is a diagram illustrating a print/erasion control circuit according to the second embodiment of the present invention.

FIG. 10 shows a control system according to the second embodiment. As shown in FIG. 10, circuits of the second embodiment are the same as those of the first embodiment except for the print/erasion control circuit 51. Referring to FIG. 11, the print/erasion control circuit 51 according to the second embodiment will be described.

In FIG. 11, the print/erasion control circuit 51 is comprised of a print/erasion data transmitter circuit 52, a print/erasion pulse control circuit 53, and a switch 54. The print/erasion data transmitter circuit 52 sends printing dot data such as a print character to the thermal print head 34 with a serial transmission system under ordinary printing circumstances, and erasing dot data to the thermal print head 34 with a serial transmission system under erasing circumstances. In ordinary erasing circumstances, overall batched erasing is performed onto the all printing portion of the rewritable card 1. In this case, the erasing dot data are all "1". These dot data are sent by a CPU 37 from a RAM 40 to the thermal print head 34 through the print/erasion data transmitter circuit 52. The print/erasion pulse control circuit 53 generates drive pulses so as to drive heat elements in each dot of the thermal print head 34 during both printing time and erasing time, and controls the driving energy. The control of the driving energy is performed by changing the drive pulse width. In this embodiment, the drive pulses of three kinds are generated as described later. The switch 54 switches the driving energy, using a DIP (dual in-line package) switch as the switch 54.

Figure 12A:
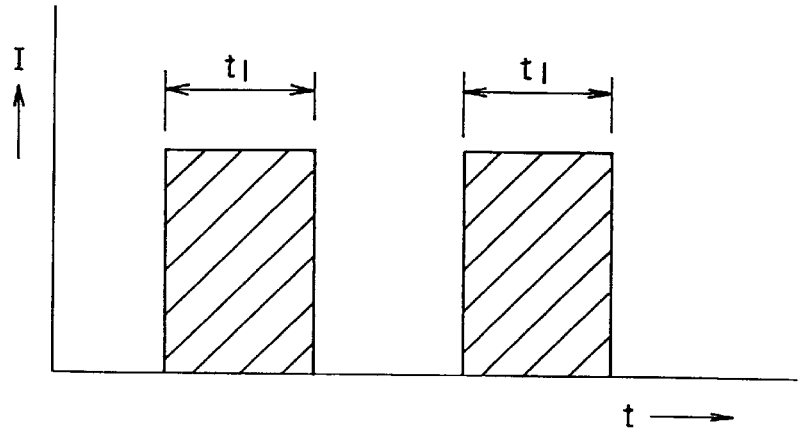
FIG. 12(*a*) is a graph illustrating thermal print head drive pulses in ordinary printing according to the second embodiment of the present invention.
Figure 12B:
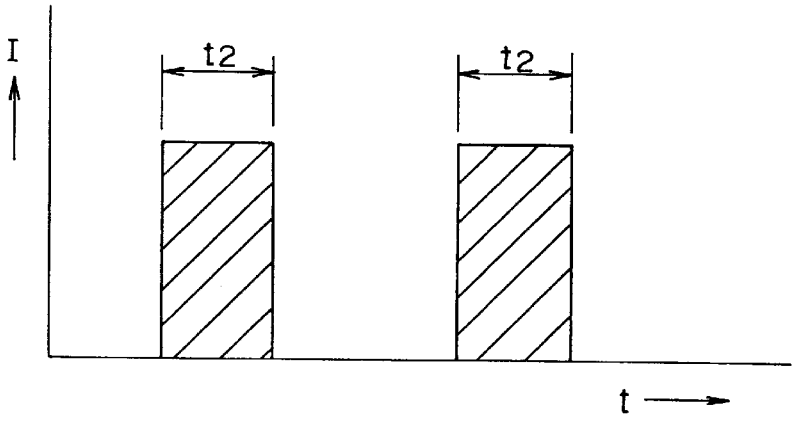
Figure 12C:
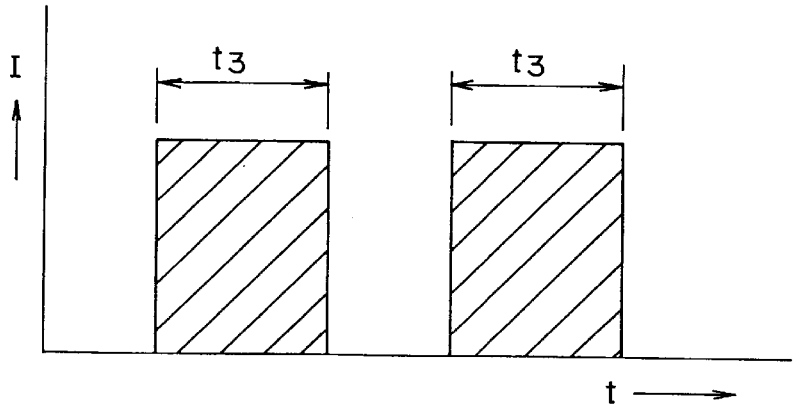

Next, referring to FIGS. 12(*a*), 12(*b*) and 12(*c*), the control of the driving energy will be described. In FIG. 12, (*a*) is a graph showing print/erasion drive pulses in ordinary printing; (*b*) is a graph showing print/erasion drive pulses in overall batched erasing; (*c*) is a graph showing print/erasion drive pulses in overall batched printing. The ordinate of each graph is for print drive current, and the abscissa thereof is for time. In FIG. 12, $t_1$, $t_2$ and $t_3$ represent the drive pulse widths. The widths $t_1$ and $t_2$ are the same as those described in the first embodiment, and the width $t_3$ is set larger than the width $t_1$. The driving energy in the overall batched printing (corresponding to the shadowed portion showed in FIG. 12(*c*)) is 40% larger than the driving energy in the ordinary printing (corresponding to the shadowed portion shown in FIG. 12 (*a*)). This is a value capable of turning the rewritable card 1 completely to the opaque state. The switch 54 is turned on in case that the drive pulse width for driving the thermal print head 34 is set to the width $t_3$, the switch 54 is turned off in case that the drive pulse width is set to the width $t_1$ or the width $t_2$.

Figure 13:
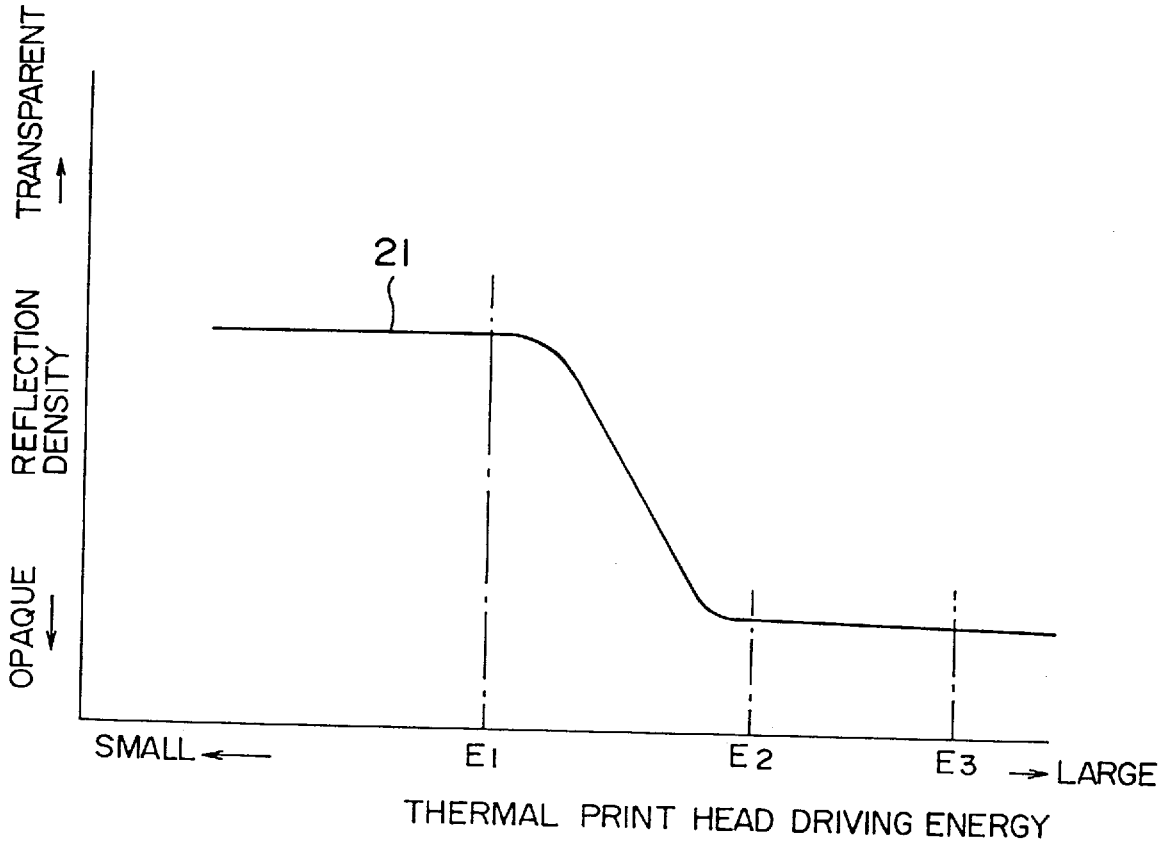
FIG. 13 is a graph illustrating driving energy according to the second embodiment of the present invention.

In FIG. 13, when the thermal print head 34 is driven with the drive pulse width $t_1$, the driving energy E2 is applied to the rewritable card 1. When the thermal print head 34 is driven with the drive pulse width $t_2$, the driving energy E1 is applied to the rewritable card 1. Then, when the thermal print head 34 is driven with the drive pulse width $t_3$, the driving energy E3 is applied to the rewritable card 1. The driving energy E3 is, as described above, applied to the overall portion on the rewritable card 1 so as to turn the rewritable card 1 completely to the opaque state.

Figure 14:
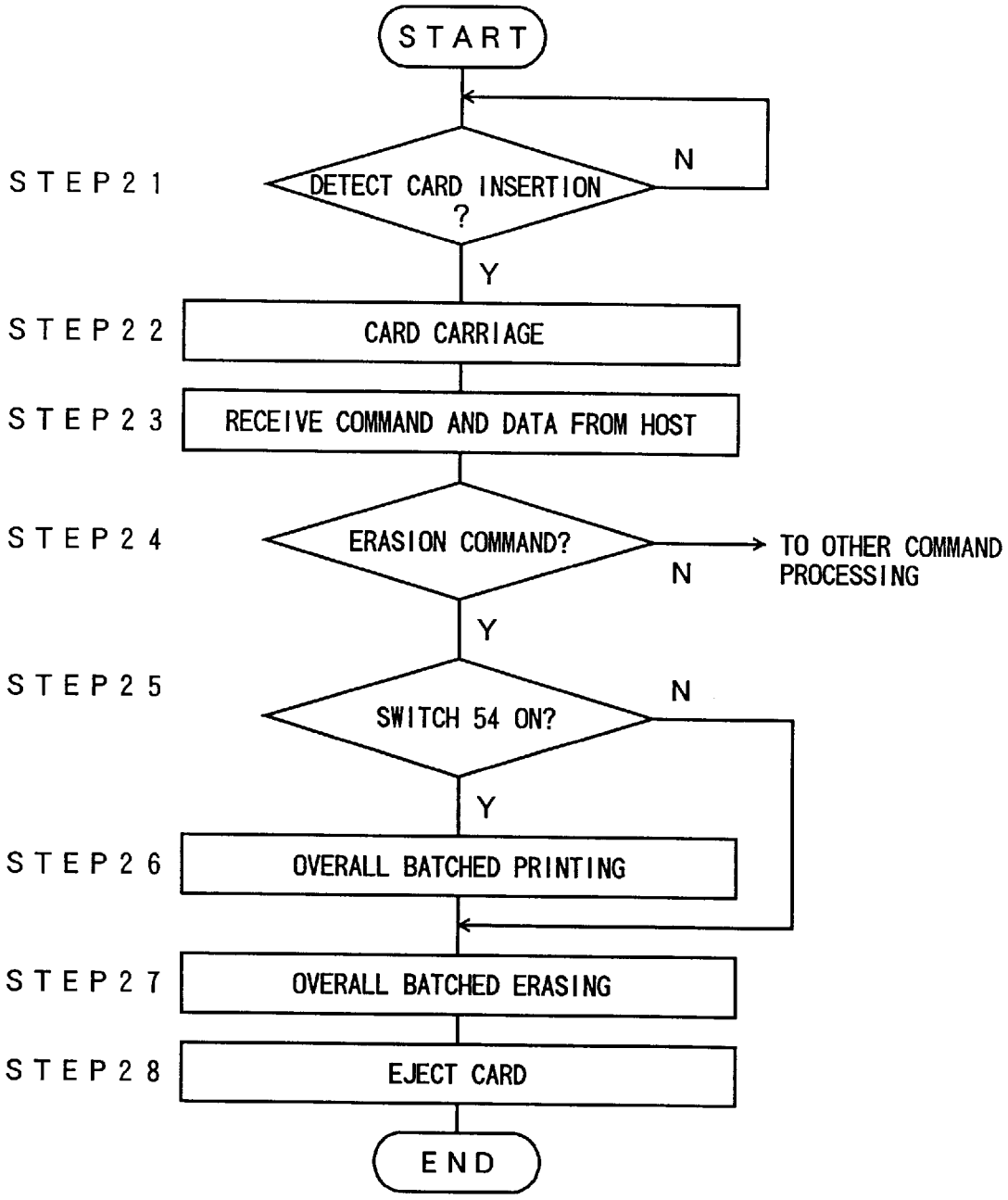
FIG. 14 is a flow chart illustrating an erasion operation according to the second embodiment of the present invention.

Next, referring to a flow chart shown in FIG. 14, the erasion operation of the second embodiment will be described. When the rewritable card 1 is inserted from the card insert port 31 at step 21, the rewritable card 1 is carried into the print/erasion unit 30 at step 22. After a command and data have been sent from the upper apparatus at step 23, a decision is made as to whether or not the command is for printing or erasion of the card at step 24, and if it is for printing, next program step goes to another processing program.

When the command for erasion is sent from the upper apparatus, a decision is made as to whether or not the switch 54 in the print/erasion control circuit 51 turns on at step 25. When the switch 54 turns on, since the CPU is set to perform the overall batched printing, the print/erasion data transmitter circuit 52 sends the overall printing data to the thermal print head 34, and the print/erasion pulse control circuit 53 outputs a drive pulse having the drive pulse width $t_3$ to the thermal print head 34. Thus, the overall batched printing is performed onto the rewritable card 1 at step 26. Next, the print/erasion data transmitter circuit 52 sends the overall printing data to the thermal print head 34, and the print/erasion pulse control circuit 53 outputs a drive pulse having the drive pulse width $t_2$ to the thermal print head 34, thus, performing the overall batched erasing at step 27.

When the switch 54 turns off, the overall batched erasing is performed without the overall batched printing. That is, when the record on the rewritable card 1, in which the erasion characteristic becomes so bad such that the rewritable card 1 does not completely return to the transparent state in an ordinary erasing manner, is erased, the original erasion characteristic can be recovered by turning the switch 54 on in off-line processing. As to the rewritable card 1 whose erasion characteristic has not deteriorated, the ordinary erasion is performed by turning the switch 54 off. The rewritable card 1 finishing the overall batched erasing is finally ejected from the insert port 31 at step 28.

As described above, even if the rewritable card recovering the erasion characteristic is repeatedly performed in the ordinary erasing, the recovered erasion characteristic will be maintained. This allows the rewritable card to obtain still greater life. Furthermore, when the print is performed onto the rewritable card recovering the erasion characteristic, the visual recognizability can be improved.

Although the overall batched printing will be effective even though it is performed by applying the ordinary driving energy E2, according to experimental results, applying 40% higher energy is the most effective. Herein, when the driving energy is set approximately 60% higher than the driving energy E2, the driving energy has the possibility of making the recording media and the like worse depending upon the used card, thus conversely reducing the durability of the recording media and the like. That is, the driving energy E3 is effective by setting it in a range from 100% to 160% higher than the driving energy E2.

(Third Embodiment)

Next, a third embodiment according to the present invention will be described. The third embodiment of the present invention includes a function in which the overall printing is performed to all regions of printing and erasion of the rewritable card by ordinary printing energy or higher energy than that in ordinary printing, and a means for performing the overall printing according to the instruction from the upper apparatus in an on-line.

Figure 15:
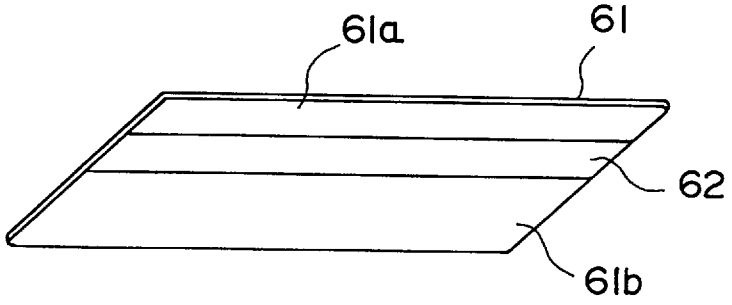
FIG. 15 is a perspective view of a rewritable card according to a third embodiment of the present invention.

FIG. 15 shows a rewritable card according to the third embodiment. In FIG. 15, a rewritable card 61 includes a magnetic stripe 62 on the opposite surface 61*b* to the printing surface 61*a* of the rewritable card 61. The magnetic stripe 62 includes an area recorded as to how many times the print/erasion processing has been performed to the rewritable card 61.

Figure 16:
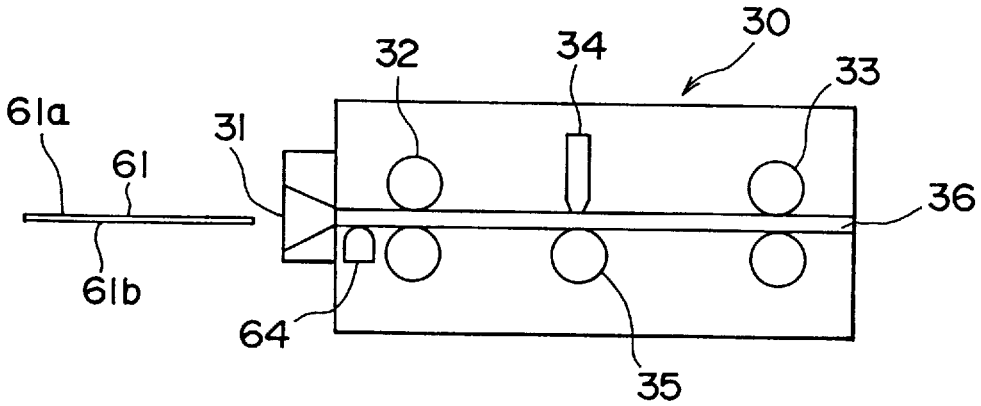
FIG. 16 is a schematic diagram illustrating a print/erasion unit used in the third embodiment of the present invention.

FIG. 16 shows a print/erasion unit 63 used in the third embodiment. In the print/erasion unit 63, there is provided a magnetic head 64 for reading and writing data onto the magnetic stripe 62 of the rewritable card 61.

FIG. 16 shows a print/erasion unit 63 used in the third embodiment. In the print/erasion unit 63, there is provided a magnetic head 64 for reading and writing data onto the magnetic strip 62 of the rewritable card 61. Other unit structures of this unit 63 are the same as those of the first embodiment.

Figure 17:
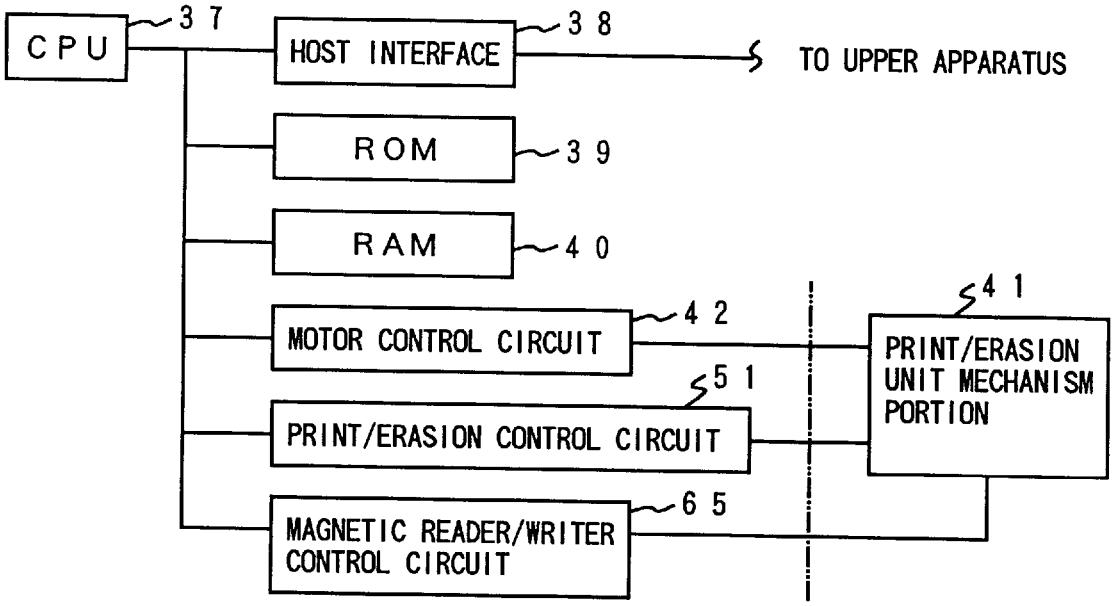
FIG. 17 is a block diagram illustrating a control portion according to a third embodiment of the present invention.

FIG. 17 is a block diagram showing a control system according to the third embodiment. As shown in FIG. 17, in the control system of the third embodiment, a magnetic reader/writer control circuit 65 is newly added. The magnetic reader/writer control circuit 65 receives data read in the magnetic head 64 and sends it the CPU 37. The ROM 39 in the control system stores in advance a predetermined number of erasion program data $N_E$. The number of erasion program data $N_E$ is set in advance on the basis of experimental data.

Figure 18:
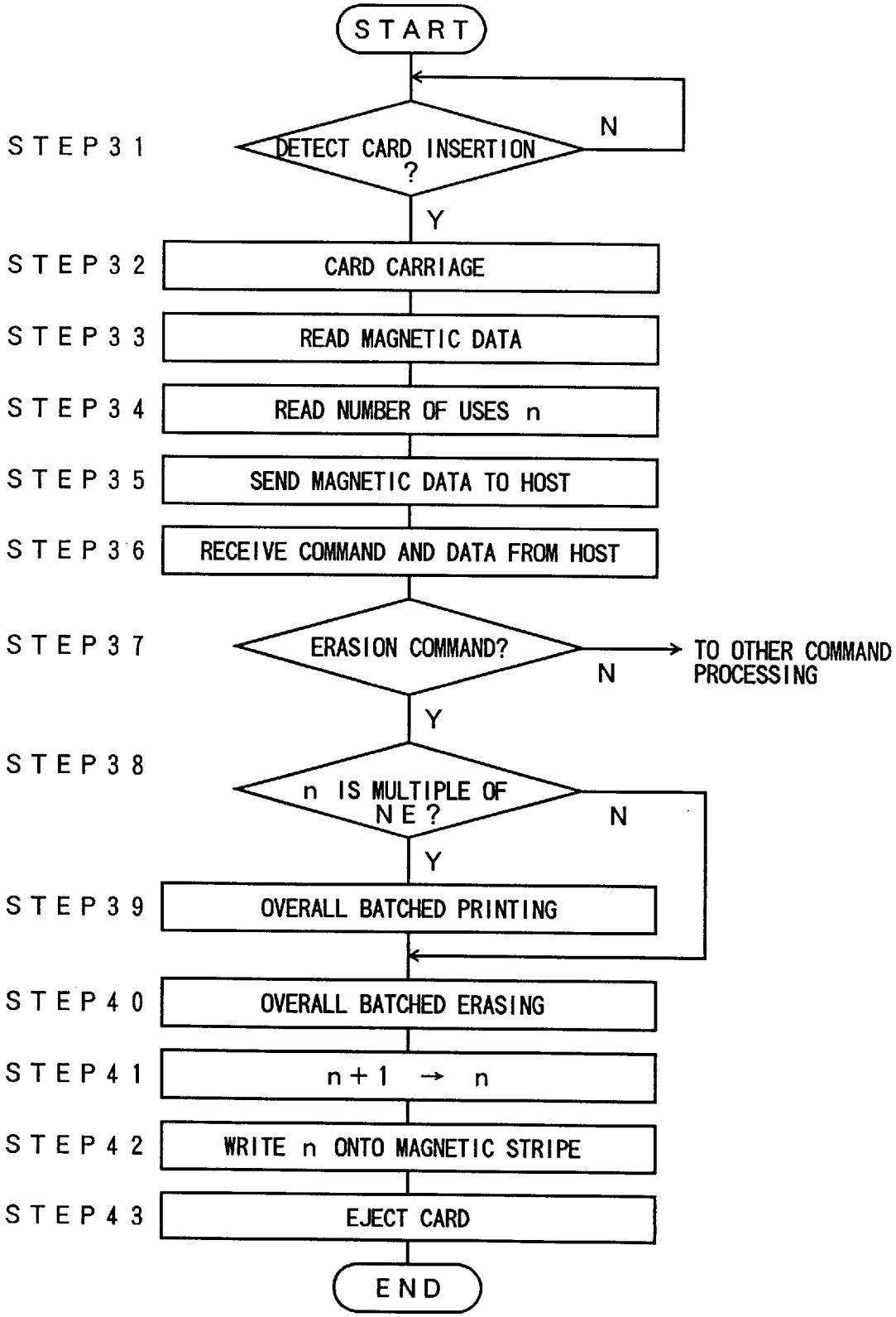
FIG. 18 is a flow chart illustrating an erasion operation according to the third embodiment of the present invention.

FIG. 18 is a flow chart showing an erasion operation according to the third embodiment. Referring to FIG. 18, the erasion operation of the third embodiment will be described.

When the rewritable card 61 is inserted from the card insert port 31 at step 31, the rewritable card 61 is carried into the print/erasion unit 30 at step 32. Next, the data on the magnetic stripe 62 is read by the magnetic head 64 at step 33. In the magnetic stripe 62, a number of duties of the rewritable card 61, i.e., how many times the rewritable card 61 has performed the print/erasion processing before, is written, and the magnetic data including a data n as to the number of duties is read (step 34). At step 35, the magnetic data is sent to the upper apparatus so as to wait a command from the upper apparatus. After the command has been sent from the upper apparatus at step 36, a decision is made as to whether the command is for printing or for erasion at step 37, and if it is for printing, next program step goes to another processing program.

When the command for erasion is sent from the upper apparatus, the CPU 37 compares the data n as to the number of duties read in step 34 with the number of erasion program data $N_E$ stored in ROM 39 in advance, and a decision is made as to whether or not the data n is a multiple of the data $N_E$ at step 38. If the data n is a multiple of the data $N_E$, the number of print/erasion processings is decided to reach a predetermined number of times so as to perform the overall batched printing at step 39. The operation of the overall batched printing can be performed in the same manner of that described in the second embodiment. Then, at step 40, the overall batched erasing is also performed in the same manner of that described in the second embodiment.

When the data n is not a multiple of the data $N_E$, the number of print/erasion processings is decided not to reach a predetermined number of items, i.e., is determined that the erasion characteristic of the rewritable card 61 is not in such a deteriorated state as to need the overall batched printing. Therefore, the overall batched erasing is performed by skipping over the program steps of the overall batched printing.

Next, the data as to the number of duties is counted up from n+1 to n at step 41, the data n as to the number of duties is written onto the magnetic stripe 62 by the magnetic head 64 at step 42. After that, the rewritable card 61 is ejected at step 43, and the operation is finished.

As described above, according to the third embodiment, whenever the print/erasion processing of the rewritable card 61 reaches a predetermined number of times, the overall batched printing is automatically performed before performing the erasion, so that the visual recognizability can be recovered before its deterioration. Furthermore, since an operator does not need to determine the deterioration of the visual recognizability in the rewritable card 61, and the operation to perform the overall batched printing, i.e., to push such as a switch is also not required, the operability of the erasion processing can be improved.

What is claimed is:

1. A thermal recording apparatus, comprising:

a print/erasion unit having a carrier path along which a thermal recording media is carried, and having heating means located on the carrier path for applying heat energy to the thermal recording media for selectively recording and erasing data on the recording media; and control means operatively connected to said heating means for selectively applying a high level driving energy to said heating means to generate a high level of heat energy, and a low level driving energy to said heating means to generate a low level of heat energy, said control means applying the high level driving energy to said heating means for effecting the recording of the data onto the thermal recording media, and applying the high level driving energy to said heating means to return the thermal recording media to a characteristic condition representative of a condition of the thermal recording media immediately after the recording of the data is effected, followed by the low level driving energy to said heating means for effecting the erasion of the data recorded on the thermal recording media; and wherein said print/erasion unit further comprises means for reciprocating the thermal recording media on the carrier path in a forward and returning direction, whereby, for the erasion of the data recorded on the thermal recording media, said control means applies the high level driving energy while the thermal recording media is moved in the forward direction, and applies the low level driving energy while the thermal recording media is moved in the returning direction.

2. The thermal recording apparatus defined in claim 1, wherein said print/erasion unit further comprises means for reciprocating the thermal recording media on the carrier path in a forward and returning direction, whereby, for the erasion of the data recorded on the thermal recording media, said control means applies the high level driving energy while the thermal recording media is moved in the forward direction, and applies the low level driving energy while the thermal recording media is moved in the returning direction.

3. The thermal recording apparatus defined in claim 1, wherein said heating means comprises a plurality of heat elements; whereby, for the erasion of data recorded on the thermal recording media said control means applies the high and low level driving energies to heat elements corresponding to a region of the thermal recording media to be erased.

4. The thermal recording apparatus defined in claim 1, wherein said heating means comprises a thermal printing head.

5. A thermal recording apparatus, comprising:

a print/erasion unit having a carrier path along which a thermal recording media is carried, and having heating means located on the carrier path for applying heat energy to the thermal recording media for selectively recording and erasing data on the thermal recording media;

control means operatively connected to the heating means for selectively applying a driving energy to the heating means, the control means applying a first level of driving energy to the heating means for effecting the recording of the data onto the thermal recording media, and applying a second level of driving energy that is at least as high as the first level of driving energy to the heating means to return the thermal recording media to a characteristic condition representative of a condition of the thermal recording media immediately after the recording of the data is effected, followed by a third level of driving energy to the heating means that is lower than the first level of driving for effecting the erasion of the data recorded on the thermal recording media: and wherein:

said print/erasion unit further comprises means for reciprocating the thermal recording media on the carrier path in a forward and returning direction, whereby, for the erasion of the data recorded on the thermal recording media, said control means applies the second level of driving energy while the thermal recording media is moved in the forward direction, and applies the third level of driving energy while the thermal recording media is moved in the returning direction.

6. The thermal recording apparatus recited in claim 5, wherein the second level of driving energy is the same as the first level of driving energy.

* * * * *